US005247228A

United States Patent [19]

Roche

[11] Patent Number: 5,247,228

[45] Date of Patent: Sep. 21, 1993

[54] FLUORESCENT LAMP BALLAST ADAPTOR

[75] Inventor: William J. Roche, Merrimac, Mass.

[73] Assignee: GTE Products Corporation, Danvers, Mass.

[21] Appl. No.: 815,789

[22] Filed: Jan. 2, 1992

[51] Int. Cl.[5] ..... H01J 7/44; H05B 39/00

[52] U.S. Cl. ..... 315/53; 439/243; 315/96; 315/97; 315/70; 315/187; 315/227 R; 315/228; 315/244; 315/276

[58] Field of Search ..... 439/243; 315/96, 97, 315/53, 70, 187, 227 R, 228, 94, 244, 276, 284

[56] References Cited

U.S. PATENT DOCUMENTS

| | | | |
|---|---|---|---|
| 4,163,176 | 7/1979 | Cohen et al. | 315/53 |
| 4,613,792 | 9/1986 | Kroessler | 315/97 |
| 4,758,173 | 7/1988 | Northrop | 439/243 |
| 4,847,536 | 7/1989 | Lowe et al. | 315/127 |
| 5,063,328 | 11/1991 | Wolton | 315/97 |

*Primary Examiner*—Robert J. Pascal
*Assistant Examiner*—Michael B. Shingleton
*Attorney, Agent, or Firm*—Carlo S. Bessone

[57] ABSTRACT

An adaptor circuit used to enable stable, flicker-free operation of T8-type fluorescent lamps in a lighting fixture which already has a standard two-lamp, series-sequence, 40 watt, rapid-start type ballast installed therein. The adaptor circuit contains an isolation transformer for controlling the voltage supplied by the ballast to the T8-type fluorescent lamps and a frequency selective impedance modifier circuit for controlling the operating current supplied by the ballast to the T8-type fluorescent lamps at preselected frequencies. In one embodiment, the frequency selective impedance modifier circuit substantially eliminates the third harmonic component of the fundamental frequency of the operating current.

17 Claims, 2 Drawing Sheets

FLUORESCENT LAMP BALLAST ADAPTOR

FIELD OF THE INVENTION

The present invention relates generally to the field of ballast adaptor apparatus for gaseous discharge lighting devices. More particularly, the present invention relates to a ballast adaptor circuit for a fluorescent lamp fixture, which allows different types of fluorescent lamps to reliably operate using the ballast already installed in the light fixture.

BACKGROUND OF THE INVENTION

A majority of fluorescent lighting installations in current service use two F40T12 type rapid-start fluorescent lamps and a standard two-lamp, series-sequence, 40 watt rapid-start ballast to supply the necessary starting voltage and operating current. The F40T12 lamp is tubular in shape, being 48 inches in length and 1½ inches in diameter. The F40T12 lamp and standard ballast combination is relatively inexpensive but is not as efficient in terms of lumens produced per watt of power consumed when compared to newer, more efficient fluorescent lamp and fixture designs. The efficiency of a conventional F40T12 lamp and standard ballast system may be improved by substituting higher efficiency T12-type lamps which use so-called "rare earth" phosphor coatings on the inside surface of the lamp. However, the higher efficiency T12-type lamps are significantly more expensive than the standard T12-type lamps which use a halo-phosphate type phosphor coating.

For a number of years, so-called "T8"-type fluorescent lamps have been available The T8-type lamp is similar in construction and materials to the conventional T12-type lamp except the T8-type lamp is one inch in diameter versus the 1½ inch diameter of a T12-type lamp. T8-type lamps are available in a variety of lengths including a 48 inch length. Using a T8-type lamp in a light fixture is a better choice in a number of lighting applications. For example, a T8-type lamp using a rare earth phosphor coating, when installed in a light fixture, produces an equal light fixture output while consuming 25% less power in comparison to a T12-type lamp with a standard halo-phosphate phosphor coating. In another example, due to the lower materials cost resulting from its reduced size, a T8-type lamp using the standard halo-phosphate coating costs less than a T12-type lamp. In installations which are presently over lighted, a T8-type lamp using the standard halo-phosphate coating can be substituted for a T12-type lamp, resulting in a 25% reduction in power consumption and a significant reduction in lamp cost, with only approximately an 8% reduction in light fixture output.

Consequently, it is desirable to be able to replace presently installed T12-type lamps with T8-type lamps to obtain their attendant advantages. Since T8-type lamps have the same connector pin configurations, spacing, and dimensions as T12-type lamps, physically substituting T8-type lamps for T12-type lamps is straightforward. The standard F40T12 lamp and standard ballast can be removed from the light fixture and replaced with a new ballast designed to operate T8-type lamps properly. However, this solution is prohibitively expensive because it essentially requires discarding the installed ballasts and purchasing new ballasts.

A better solution is to simply remove the F40T12 fluorescent lamps from the fixture and replace them with T8-type lamps having the same length as the F40T12 lamps. However, T8-type lamps and T12-type lamps are not electrically compatible. The standard two-lamp, series-sequence, 40 watt rapid-start ballast used to operate the F40T12 lamps is not compatible with T8-type lamps for two reasons. First, the starting voltage delivered by the ballast is too low to start a T8-type lamp. Second, the ballast impedance of the standard 40 watt T12-type ballast is too low to operate a T8-type lamp in a stable manner. A typical Argon-filled T8-type lamp requires an open circuit (i.e., starting) voltage of 315 volts and a peak voltage of 290 volts in order to start the lamp. However, the standard 40 watt T12-type ballast is only capable of delivering an open circuit voltage of 256 volts and a peak voltage of 240 volts. Consequently, the standard 40 watt T12-type ballast cannot operate a T8-type lamp.

Therefore, an object of the present invention is to provide an adaptor circuit for allowing selected fluorescent lamps to operate using a predetermined ballast such that a user may choose a particular fluorescent lamp depending on desired illumination level and lamp cost.

Another object of the present invention is to provide a frequency selective adaptor circuit for use with a standard T12-type ballast which allows reliable, flicker-free operation of T8-type fluorescent lamps.

Another object of the present invention is to provide a frequency selective adaptor circuit for rapid-start type fluorescent lamps which allows a selected fluorescent lamp to reliably operate in a light fixture having a predetermined, installed ballast.

Yet another object of the present invention is to provide a cost effective alternative to ballast replacement which allows T8-type fluorescent lamps to efficiently and stably operate in a light fixture having a standard T12-type ballast installed therein.

SUMMARY OF THE INVENTION

The foregoing and other objects and advantages of the present invention are achieved in an adaptor circuit that enables stable, flicker-free operation of a selected fluorescent lamp. The adaptor circuit couples between a predetermined ballast, coupled to and receiving power from a power source, which supplies a predetermined operating voltage and operating current, and the selected fluorescent lamp. The adaptor circuit includes an isolation transformer means for controlling the voltage supplied by the ballast to the selected fluorescent lamp and a frequency selective impedance modifier circuit for controlling the operating current supplied by the ballast to the selected fluorescent lamp at preselected frequencies. In a preferred embodiment of the invention, the selected fluorescent lamp is a T8-type fluorescent lamp and the predetermined ballast is a two-lamp, series-sequence, 40 watt rapid-start ballast. The adaptor circuit is generally installed as an additional component in a light fixture. The adaptor circuit substantially attenuates or eliminates the third harmonic of the fundamental frequency of the operating current to eliminate flickering thus ensuring stable operation. The adaptor circuit may also provide a voltage step-up or step-down function, depending on the voltage required to operate the selected fluorescent lamp. In other embodiments of the invention, a narrowband filtering function is provided which reduces the third harmonic without affecting the lamp power. In another embodiment of the invention, the adaptor circuit substantially attenuates or eliminates the current in the third harmonic of the fundamental frequency of the operating current as well as reducing the power supplied to the fluorescent lamp.

BRIEF DESCRIPTION OF THE DRAWINGS

In the drawings, wherein like elements have been given like reference characters.

DETAILED DESCRIPTION OF THE INVENTION

For purposes of illustration only, and not to limit generality, the present invention will now be explained with reference to its use in operating a typical light fixture having a pair of series connected fluorescent lamps and a standard two-lamp, series-sequence, 40 watt rapid-start ballast. However, one skilled in the art will recognize that the adaptor circuit of the present invention may be modified to operate other types and combinations of fluorescent lamps and ballasts.

Figure 1:
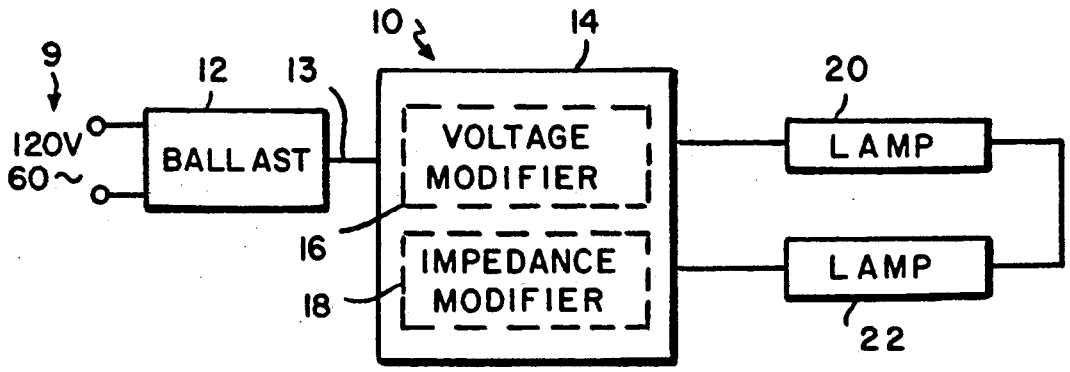
FIG. 1 is a schematic block diagram of the adaptor circuit of the present invention that allows a standard two-lamp, series-sequence 40 watt rapid-start ballast to operate T8-type fluorescent lamps.

Reference is now made to FIG. 1, which illustrates the general configuration of a fluorescent lamp circuit 10 using the adaptor circuit of the present invention. A ballast 12 is a standard two-lamp, series-sequence, 40 watt rapid-start ballast which supplies a starting voltage and an operating current to start and operate a series connected pair of T8-type lamps 20 and 22. Ballast 12 receives operating power from line 9, which is typically a 120 volt, 60 Hz power line. Between an output 13 of ballast 12 and lamps 20 and 22 is an adaptor circuit 14 which includes a voltage modifier 16 and an impedance modifier 18. Voltage modifier 16 adjusts the voltage supplied by ballast 12 to a level required to start lamps 20 and 22. In a preferred embodiment, voltage modifier 16 is an isolation transformer for controlling the voltage supplied by the ballast to lamps 20 and 22 and may be a step-up or step-down transformer depending upon the particular requirements of lamps 20 and 22. Impedance modifier 18 determines a lamp current and provides a frequency selective attenuating function which substantially attenuates or eliminates an operating current supplied by ballast 12 at output 13 at preselected frequencies. The particular construction of impedance modifier 18 depends on the model of T8-type lamp used in the circuit as well as the operating power level of the lamp. In a preferred embodiment, impedance modifier 18 includes a capacitor and inductor, connected in series or in parallel, depending upon the particular model of lamps 20 and 22.

Figure 2:
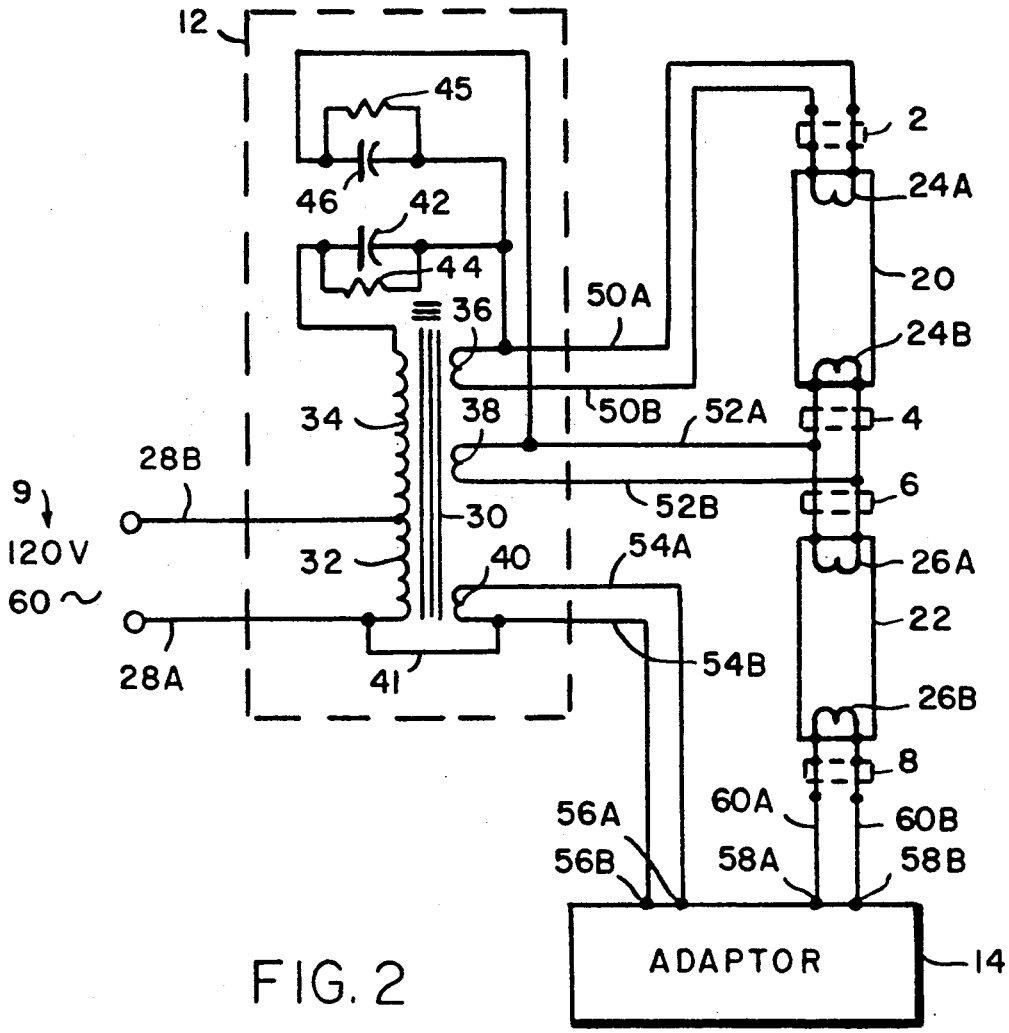
FIG. 2 is a schematic block diagram of the adaptor circuit illustrated in FIG. 1 used to operate "high power" T8-type lamps on a standard two-lamp, series-sequence, 40 watt rapid-start ballast.

Reference is now made to FIG. 2, which illustrates an example of adaptor circuit 14 used in a "high power" fluorescent lamp circuit. The circuit of FIG. 2 is referred to as "high power" because lamps 20 and 22 are operated close to the 40 watt power rating of ballast 12.

Lamps 20 and 22 are T8-type lamps, preferably having a fill gas of 75% Krypton and 25% Argon at a pressure of 1.5 Torr and also having an internal conductive film of $SnO_2$ on the interior surface of the lamp to act as a starting aid. Lamps 20 and 22 are of the rapid-start type having continuously heated filaments 24A, 24B and 26A, 26B, respectively. Lamps 20 and 22 may be, for example, 36 watt, 48 inch long fluorescent lamps, having an internal conducting film of $S_nO_2$, such as a variation of model number F36T8made by GTE Products Corporation.

Ballast 12 is a conventional two-lamp, series-sequence, 40 watt rapid-start ballast which delivers a filament voltage of 3.7 volts, a starting voltage of 256 volts, a peak voltage of 240 volts, and a rated current of 430 Ma. Ballast 12 receives electrical power, typically 120 volts, 60 Hz via electric leads 28A, 28B. The ballast 12 typically includes a high leakage reactance voltage step-up autotransformer having low voltage filament windings of conventional structure and contains a core 30 of magnetic material, a primary winding 32 connected as illustrated to the power input leads 28A, 28B, a high voltage secondary winding, 34, connected electrically in autotransformer relationship with the primary winding 32 and magnetically in high leakage reactance relationship with the primary winding, and three additional step-down secondary windings 36, 38, and 40, called filament windings. Filament windings 36, 38, and 40 supply the filament voltage, typically 3.7 volts, for filaments 24A, 24B, 26A, and 26B. A first power factor capacitor 42 is connected electrically in series with one end of secondary winding 34 and secondary winding 36, and a resistor 44 is connected in parallel with capacitor 42. A second starting capacitor 46 is connected electrically in series between capacitor 42 (and secondary winding 36) and secondary winding 38. A resistor 45 is connected in parallel with capacitor 46. An electrical connection 41 is provided between one end of filament winding 40 and primary winding 32. The elements of ballast 12 are generally enclosed within a ballast container and impregnated with an encapsulating material, such as asphalt, epoxy resin or the like and sealed. As a practical matter, the elements within ballast 12 are inaccessible.

Lamps 20 and 22 are T8-type rapid-start fluorescent lamps which are typically one inch in diameter and 48 inches in length when replacing F40T12 type lamps. The lamps are long cylindrical glass tubes and typically have two electrical pins or terminals extending from each end, with one pin connected to a corresponding end of the associated lamp filament. The lamp terminals are inserted into corresponding electrical sockets (shown at 2, 4, 6, and 8) in a lamp fixture, which physically supports the lamps and electrically connects lamps 20 and 22 into the circuit.

Electric leads 50A and 50B extend from filament winding 36 (typically the "red wires") and are connected to filament 24A. Electric leads 52A, 52B extend from secondary winding 38 (typically the "yellow wires") and are connected to filaments 24B and 26A. Electric leads 54A, 54B extend from secondary winding 40 (typically the "blue wires") and are connected to terminals 56A, 56B of adaptor circuit 14. Terminals 58A, 58B of adaptor circuit 14 are in turn connected via electric leads 60A, 60B to filament 26B of lamp 22. The starting voltage delivered by ballast 12 is typically measured between electric lead 50A and electric lead 54B. The peak voltage delivered by ballast 12 is typically measured between electric lead 50A and a circuit ground.

In the high power circuit illustrated in FIG. 2, adaptor circuit 14 may be inserted between lamp filament 26B and filament winding 40 or between lamp filament 24A and filament winding 36. Adaptor circuit 14 is generally an additional component installed in the light fixture.

Figure 3:
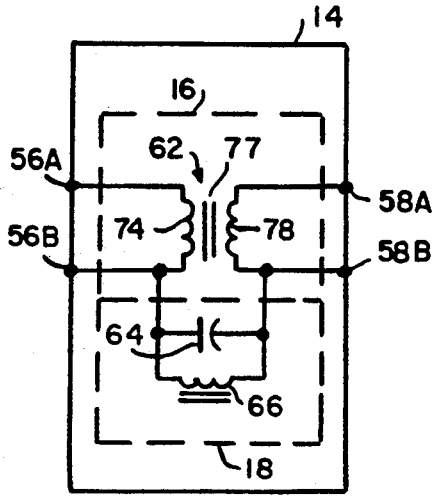
FIG. 3 is a detailed schematic diagram of the adaptor circuit illustrated in FIG. 2.

Reference is now made to FIG. 3, which figure is a schematic diagram of the circuitry used in adaptor 14 of FIG. 2. Adaptor 14 includes an isolation transformer 62 connected between terminals 56A, 56B and terminals 58A, 58B. Transformer 62 has a primary winding 74 and a secondary winding 78 and an iron core 77. A capacitor 64 and an inductor 66 are connected in parallel with each other and are connected between terminals 56B and 58B (thus bridging primary winding 74 and secondary winding 78 of transformer 62). Capacitor 64 and inductor 66 comprise the impedance modifier portion 18 of adaptor circuit 14. Transformer 62 magnetically couples the 3.7 volt ballast filament winding 40 to lamp filament 26B to bypass impedance modifier portion 18 to prevent impedance modifier portion 18 from changing the filament power delivered by filament winding 40 to filament 26B.

In the particular case of the high power lamp circuit using F36T8type lamps, transformer 62 does not provide any voltage adjusting function, since the particular T8lamps have a high percentage of Krypton and internal conductive films for starting and do not require an increase in starting voltage. Transformer 62 is simply an isolation transformer with a 1:1 voltage ratio between primary winding 74 and secondary winding 78. However, additional impedance, provided by capacitor 64 and inductor 66 is required so that the lamps will operate in a stable manner. Stable operation means that the lamp operates without flickering. Flickering in T8-type fluorescent lamps is caused by the current in a third harmonic of a fundamental frequency of the lamp current waveform delivered by secondary winding 34 of ballast 12. The fundamental frequency of the lamp current is typically 60 Hz by virtue of the 60 Hz power line 9. The impedance modifier 18 of adaptor circuit 14 in FIG. 3 is designed to substantially attenuate or eliminate the third harmonic current from the lamp current waveform. Eliminating the third harmonic current also reduces a lamp current crest factor (the ratio of peak lamp current to RMS lamp current), which results in longer lamp life and improved operating efficiency. For the circuit illustrated in FIG. 3, capacitor 64 has a value of approximately 12 microfarads and inductor 66 has a value of approximately 66 millihenries. The impedance modifier circuit of FIG. 3 is a narrowband filter which filters out undesired frequency components (the third harmonic current at 180 Hz) without reducing the lamp current supplied at the 60 Hz fundamental frequency, so that lamp power is not reduced. Consequently, the circuit of FIG. 3 allows T8-type lamps to be operated with a standard two-lamp, series sequence, 40 watt rapid-start ballast very close to the 40 watt power rating of the ballast.

Figure 4:
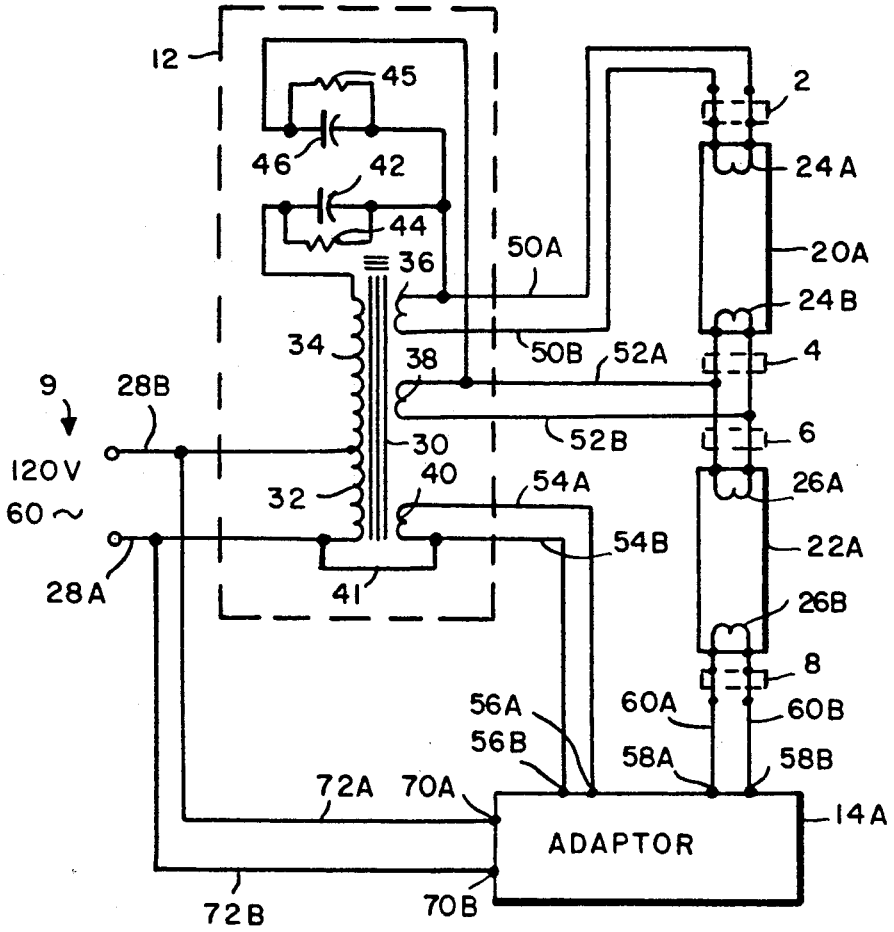
FIG. 4 is a schematic diagram of the adaptor circuit illustrated in FIG. 1 used to operate "low power" T8-type lamps on a standard two-lamp, series-sequence, 40 watt rapid-start ballast.

Reference is now made to FIG. 4, which illustrates a schematic block diagram of a "low power" T8circuit. The circuit of FIG. 4 allows an Argon-filled T8-type lamp to be operated close to the wattage value of a standard 32 watt T8lamp and ballast system, while using a standard two-lamp, series sequence, 40 watt rapid-start ballast.

Referring more specifically to FIG. 4, lamps 20A and 22A are Argon-filled T8-type lamps such as 32 watt, 48 inch long F32T8type lamps available from GTE Products Corporation. The circuit of FIG. 4 is referred to as "low power" because the lamps are designed to consume 32 watts each, as opposed to the 40 watts consumed by the standard F40T12 type lamps. The circuit of FIG. 4 is connected in the same manner as the circuit of FIG. 2, but with the following differences. Adaptor circuit 14A is connected to lamp filament 26B via electric leads 60A, 60B at terminals 58A, 58B. Adaptor circuit 14A also receives electrical power from power line 9 at terminals 70A, 70B via electric leads 72A, 72B. Adaptor circuit 14A is connected to filament winding 40 of ballast 12 via electric leads 54A and 54B at terminals 56A, 56B. Adaptor circuit 14A is generally an additional component installed in the light fixture.

Figure 5:
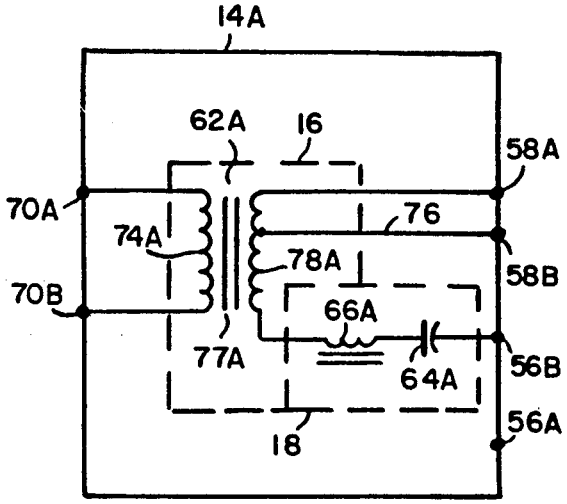
FIG. 5 is a detailed schematic diagram of the adaptor circuit illustrated in FIG. 4.

Reference is now made to FIG. 5, which is a schematic diagram of adaptor circuit 14A illustrated in FIG. 4. In the circuit illustrated in FIG. 4, adaptor circuit 14 provides both a voltage boosting function and an impedance matching function. An isolation transformer 62A has a primary winding 74A, a secondary winding 78A, and an iron core 77A. Transformer 62A functions as the voltage modifier 16 of adaptor circuit 14. The primary winding 74A of transformer 62A is connected to the power line at terminals 70A and 70B. The secondary winding 78A of transformer 62A is connected to heater filament 26B at terminals 58A and 58B. Terminal 58B is connected to a tap 76 in secondary winding 78A of transformer 62A. A capacitor 64A is connected in series with an inductor 66A between terminal 56B and secondary winding 78A of transformer 62A and forms the impedance modifier 18 in adaptor circuit 14. Terminal 56B, in a preferred embodiment, is connected to electric lead 54B which is in turn connected to a higher voltage side of filament winding 40 of ballast 12. Electric lead 54A is not used in the circuit of FIG. 4 and is connected to a dummy terminal 56A in adaptor circuit 14. However, the circuit also works when terminal 56B of adaptor circuit 14 is connected via electric lead 54A to the lower voltage side of filament winding 40. In that case, electric lead 54B is connected to the dummy terminal 56A in adaptor circuit 14A.

The F32T8Argon-filled T8-type lamp requires a starting voltage of approximately 315 volts. However, the standard two-lamp, series-sequence, 40 watt rapid-start ballast can supply a starting voltage of only 256 volts. Consequently, transformer 62A is used to increase the available starting voltage. Transformer 62A is a 2:1 step-down type transformer which reduces the power line voltage between terminals 70A and 70B by approximately 50% typically from approximately 120 volts to approximately 60 volts. The 60 volts between terminals 58A and 56B of secondary winding 78A is added to the voltage supplied by ballast transformer 12 at terminal 56B to provide a required starting voltage of approximately 315 volts.

The F32T8type fluorescent lamp requires reduced current at the third harmonic (180 Hz) of the 60 Hz fundamental frequency of the operating current to eliminate lamp flicker as well as reduced current at the 60 Hz fundamental frequency, because of the lower power consumed by this lamp since it is a 32 watt device. The series connection of inductor 66A and capacitor 64A thus provides the required attenuation over a broad band of frequencies, including 60 Hz and 180 Hz. The values of inductor 66A and capacitor 64A are chosen so that the resonant frequency of the circuit falls between 60 Hz and 180 Hz. The series connection of inductor 66A and capacitor 64A increases the current lead impedance at 60 Hz and increases the current lag impedance at 180 Hz, resulting in a reduction in the operating current supplied at both frequencies. In a typical case where a two-lamp, series-sequence, 40 watt rapid-start type ballast transformer is used with an F32T8type lamp, inductor 66A has a value of approximately 0.9 Henries and capacitor 64A has a value of approximately 3 microfarads.

The circuits illustrated in FIGS. 2-5 provide two specific examples of the adaptor circuit of the present invention One skilled in the art will appreciate that the specific circuit configuration of adaptor circuit 14 depends upon the particular model of T8-type fluorescent lamp being used in the circuit. When the selected T8-type fluorescent lamp only requires a reduction in the third harmonic frequency of the operating current, then the narrowband type filter circuit illustrated in FIG. 3 is an appropriate design. However, when the chosen T8-type fluorescent lamp requires a reduction in operating current at the third harmonic of the operating current frequency and a reduction in power, then the broadband type filter circuit illustrated in FIG. 5 is appropriate. One skilled in the art will also appreciate that the values chosen for inductor 66 and capacitor 64 depend upon the particular power line frequency as well as the particular frequencies at which operating current needs to be reduced to assure proper lamp operation.

The present invention provides the end user with the flexibility to tailor a lighting system to the particular result desired. For example, the adaptor circuit of the present invention allows the end user to achieve a cost savings by using lower-cost, lower power, and higher efficiency T8-type lamps having the same phosphor composition as a standard F40T12 cool white lamp. On the other hand, the adaptor circuit of the present invention allows the end user to use newer, more efficient T8-type lamps having rare earth phosphors to achieve the same light fixture output as a standard F40T12 type lamp, while consuming less power.

Furthermore, the present invention differs from so-called power reducers known in the art. The purpose of these prior art power reducers is to reduce the power consumed by a fluorescent lamp by simply reducing the lamp current. These prior art power reducers, unlike the present invention, are not selective with respect to the frequency at which attenuation of current takes place and would not enable fluorescent lamps to operate with ballasts for which they were not designed. Since prior art power reducers simply reduce the overall operating current, they suffer from the drawback that the illumination is reduced as well. By contrast, in the present invention, the amount of illumination can be increased or decreased depending on the model of T8-type lamp selected and the value of the components used in the impedance modifier.

Having thus described one particular embodiment of the invention, various alterations, modifications, and improvements will readily occur to those skilled in the art. Such alterations, modifications, and improvements as are made obvious by this disclosure are intended to be part of this disclosure although not expressly stated herein, and are intended to be within the spirit and scope of the invention. Accordingly, the foregoing description is by way of example only and is not intended as limiting. The invention is limited only as defined in the following claims and the equivalents thereto.

I claim:

1. An adaptor circuit for coupling between a predetermined ballast, coupled to and receiving power from a power source, which supplies a predetermined operating voltage and operating current, to a selected fluorescent lamp, comprising:

an isolation transformer means for controlling the voltage supplied by the ballast to the selected fluorescent lamp; and a frequency selective impedance modifier circuit coupled to the isolation transformer means for reducing the third harmonic frequency of the operating current supplied by the ballast to the selected fluorescent lamp.

2. The apparatus of claim 1 wherein the isolation transformer includes a primary winding and at least one secondary winding.

3. The apparatus of claim 2 wherein the frequency selective impedance modifier circuit comprises an attenuator circuit having a predetermined bandwidth.

4. The apparatus of claim 3 wherein the frequency selective impedance modifier circuit comprises at least one inductor coupled to at least one capacitor.

5. The apparatus of claim 3 wherein the isolation transformer comprises a step-up transformer.

6. The apparatus of claim 3 wherein the isolation transformer comprises a step-down transformer.

7. The apparatus of claim 4 wherein the inductor is coupled in parallel with the capacitor.

8. The apparatus of claim 4 wherein the inductor is coupled in series with the capacitor.

9. The apparatus of claim 7 wherein the capacitor and inductor are coupled between the primary winding of the isolation transformer and the secondary winding of the isolation transformer.

10. The apparatus of claim 9, wherein:

the selected fluorescent lamp is a rapid-start type fluorescent lamp having a heater filament and the filament is coupled to the secondary winding of the isolation transformer; and the ballast further includes at least one filament winding for supplying a filament voltage and a filament current.

11. The apparatus of claim 8, wherein:

the selected fluorescent lamp is a rapid-start type fluorescent lamp having a heater filament;

the secondary winding of the isolation transformer further comprises two terminals and a tapped connection;

the ballast further comprises at least one filament winding for supplying a filament voltage and a filament current;

the filament of the selected fluorescent lamp is coupled to the tapped connection and one terminal of the secondary winding of the isolation transformer;

the primary winding of the isolation transformer is coupled to the power source; and the series-connected capacitor and inductor are coupled between the other terminal of the secondary winding of the isolation transformer and the filament winding.

12. The apparatus of claim 11 wherein:

the selected fluorescent lamp is a T8-type fluorescent lamp;

the ballast is a rapid-start ballast designed to operate a T12-type fluorescent lamp; and a value of the capacitor and a value of the inductor are selected to reduce a current in a fundamental frequency of the operating current and a current in a third harmonic of the fundamental frequency of the operating current.

13. The apparatus of claim 10, wherein:

the selected fluorescent lamp is a T8-type fluorescent lamp;

the ballast is a rapid-start ballast designed to operate a T12-type fluorescent lamp; and a value of the capacitor and a value of the inductor are selected to reduce a current in a third harmonic of a fundamental frequency of the operating current.

14. An adaptor circuit for coupling between first and second selected rapid-start fluorescent lamps each having first and second heater filaments, and a predetermined series-sequence rapid-start ballast having a primary winding, a secondary winding, and three filament windings, the primary winding being coupled to and receiving power from a power source, the secondary winding coupled to and supplying a predetermined operating voltage and operating current to the first and second selected fluorescent lamps, one of the filament windings being coupled to a first heater filament in the first fluorescent lamp, a second one of the filament windings being coupled to a first heater filament in the second fluorescent lamp, and a third one of the filament windings being coupled to the second heater filament in the first fluorescent lamp and the second heater filament in the second fluorescent lamp, the adaptor circuit coupled between the first heater filament in the second fluorescent lamp and the second one of the filament windings, comprising:

an isolation transformer means for controlling the voltage supplied by the ballast to he selected fluorescent lamp; and frequency selective impedance modifier means coupled to the isolation transformer means for reducing the third harmonic frequency of the operating current supplied by the ballast to the first and second selected fluorescent lamps.

15. The apparatus of claim 14, wherein the frequency selective impedance modifier means includes an attenuator means having a predetermined bandwidth for reducing a current in a third harmonic of a fundamental frequency of the operating current.

16. The apparatus of claim 15, wherein the selected fluorescent lamps are T8-type lamps and the predetermined blast is a standard two-lamp, series-sequence, 40 watt, rapid-start ballast.

17. In a fluorescent lighting apparatus including a T12-type ballast having a primary winding and a secondary winding, the primary winding coupled to and receiving power from a power source, the secondary winding supplying an operating voltage and an operating current for at least one T12-type fluorescent lamp, an adaptor circuit that enables stable operation of at least one T8-type fluorescent lamp coupled to the secondary winding, the adaptor circuit being coupled between the secondary winding of the ballast and the at least one T8-type fluorescent lamp, comprising:

an isolation transformer means for controlling the voltage supplied by the ballast to the selected fluorescent lamp; and a frequency selective impedance modifier means coupled to the isolation transformer means for reducing the third harmonic frequency of the operating current supplied by the ballast to the T8-type fluorescent lamp.

* * * * *